United States Patent [19]

Everett, Jr.

[11] Patent Number: 4,588,316

[45] Date of Patent: May 13, 1986

[54] OPTICALLY CONTROLLED MULTI-COLOR IMPACT PRINTER

[75] Inventor: Seth L. Everett, Jr., Lincroft, N.J.

[73] Assignee: The United States of America as represented by the Secretary of the Army, Washington, D.C.

[21] Appl. No.: 721,096

[22] Filed: Apr. 8, 1985

[51] Int. Cl.[4] ..... B41J 35/04; B41J 35/16

[52] U.S. Cl. ..... 400/248; 400/124; 400/229; 400/240.4

[58] Field of Search ..... 400/124, 229, 240.4, 400/249, 248, 248.3; 101/93.05, 336

[56] References Cited

U.S. PATENT DOCUMENTS

| | | | |
|---|---|---|---|
| 3,941,051 | 3/1976 | Barrus et al. | 101/93.05 |
| 4,091,913 | 5/1978 | Ku | 400/248 X |
| 4,110,050 | 8/1978 | Wood | 400/248 |
| 4,114,750 | 9/1978 | Baeck et al. | 400/279 |
| 4,165,188 | 8/1979 | Rempel | 400/248 X |
| 4,289,069 | 9/1981 | Mellisa et al. | 101/93.04 X |

FOREIGN PATENT DOCUMENTS

| | | | |
|---|---|---|---|
| 55-154193 | 12/1980 | Japan | 400/240.4 |
| 57-6786 | 1/1982 | Japan | 400/240.4 |
| 58-193184 | 11/1983 | Japan | 400/240.4 |

OTHER PUBLICATIONS

*IBM Tech. Disc. Bulletin,* by E. N. Dials, vol. 23, No. 9, Feb. 1981, pp. 4199–4200.

IBM Tech. Discl. Bull., vol. 22, No. 7, Dec. 1979, pp. 2633–2635, "Multicolor Printing", G. N. Baker et al.

*Primary Examiner*—Paul T. Sewell

*Attorney, Agent, or Firm*—Anthony T. Lane; Jeremiah G. Murray; Paul A. Fattibene

[57] ABSTRACT

An inherently rugged multi-color dot matrix impact printer having a yoke type optical code detector assembly mounted on the neck portion of an impact dot matrix print head through which a multi-colored print ribbon passes. The print ribbon is configured in alternating vertical segments of selected colors of ink which have top and bottom photo-optical code regions on the outer edge of the ribbon. Coding comprises the presence or lack of an aperture in the form of a hole which is adapted to pass light therethrough and which is aligned with each ink segment. The yoke additionally includes upper and lower light emitter/sensor pairs for sensing the coded aperture pattern to control the presence of a predetermined colored segment of printing ribbon in front of the print head.

18 Claims, 6 Drawing Figures

OPTICALLY CONTROLLED MULTI-COLOR IMPACT PRINTER

This invention may be manufactured and used by or for the Government for governmental purposes without the payment of any royalties thereon or therefor.

BACKGROUND OF THE INVENTION

1. Field of the Invention

This invention relates generally to impact moving carriage printers and more particularly to means for printing in multiple colors in conjunction with a dot matrix print head.

2. Description of the Prior Art

Dot matrix impact moving carriage printers are well known and typically include a print head containing a plurality of solenoid actuated print wires to selectively drive each print wire against an inked ribbon located above the surface of a sheet or web of paper to print a row of dots to form an alpha-numeric character. The print head is conventionally mounted on a carriage which is adapted to move transversely across the paper while a predetermined number of print wires are selectively driven against the ribbon and paper to form a desired character or design. Illustrative examples of such apparatus include the printing systems disclosed in U.S. Pat. No. 3,941,051, entitled, Printer System", which issued to G. B. Barrus, et al. on Mar. 2, 1976 and U.S. Pat. No. 4,114,750, entitled, "Printer System Having Local Control Dynamically Alterable Printing", which issued to H. S. Baeck, et al. on Sept. 19, 1978.

While dot matrix printers were first designed to print in only a single color, more recently a color print capability has been added. A typical example of a color printer is disclosed in U.S. Pat. No. 4,289,069, entitled, "Method For Producing A Multiple Color Hard Copy Image", which issued to R. F. Melissa, et al. on Sept. 15, 1981. There a system is described which includes an ink ribbon having multiple zones of different colors carrying encoded identifying indicia. In response to input data defining a dot pattern in the color in which it is to be printed, the ribbon is searched to position the first identified ribbon color zone in front of the impact hammers. Two sets of coding holes for identifying the various colored zones of the ink ribbon are included on the edge of the ribbon which permits the ribbon to be inverted on demand as required; however, only one edge set of holes is used at a time.

Other color ribbon detection schemes are disclosed in: Japanese Pat. No. 55-154193, entitled, "Printer Adopting Multi-Color Ribbon"; Japanese Pat. No. 57-6786, entitled, "Multi-Color Ink Ribbon"; and Japanese Pat. No. 58-193184, entitled, "Thermo-Sensitive Color Transfer Apparatus". In the first mentioned Japanese patent, the color detection is provided by intervening zones of ribbon material containing color coded hole patterns. In the second Japanese patent, successive regions of multi-color ribbon are detected directly by light reflected from the surface of the ribbon. In the last remaining patent, a set of color code marks are included on the upper edge of the color ribbon having three primary colors alternating in sequence along the length of the ribbon.

Still another method of directly detecting different color segments of a print ribbon is disclosed in IBM Technical Disclosure Bulletin, Volume 22, No. 7, December, 1979, at pages 2633–2635 and being entitled, "Multi-Color Printing" by G. N. Baker, et al.

Accordingly, it is an object of the present invention to provide an improvement in impact type dot matrix printers.

It is a further object of the invention to provide a dot matrix printer for printing in a plurality of colors.

Another object of the invention is to provide a relatively low cost yet rugged color printer.

Still another object of the invention is to provide improvement in means for sensing different color segments of an ink ribbon utilized in connection with the impact type printer and thereafter selectively positioning a desired color segment in front of a print head.

SUMMARY

Briefly, the foregoing and other objects of the invention are provided by improved means for sensing color coded segments of a multi-color ink ribbon which is fed past a movable print head. The print head is operable to print indicia on the face of a printing medium comprising, for example, a web or sheet of paper. The sensing means act in conjunction with a multi-color print ribbon consisting of sequential segments of different ink colors with the top and bottom edge of the ribbon including photo-optical coding means in the form of holes or the absence thereof which are sensed by upper and lower pairs of photo-emitter and sensor elements located in a yoke type of housing structure which fits over the nose or neck portion of a conventional dot matrix print head.

BRIEF DESCRIPTION OF THE DRAWINGS

While the present invention is defined in the claims annexed to and forming a part of this specification, a better understanding can be had by reference to the following description when taken in conjunction with the accompanying drawings in which:

DESCRIPTION OF THE PREFERRED EMBODIMENT

Figure 1:
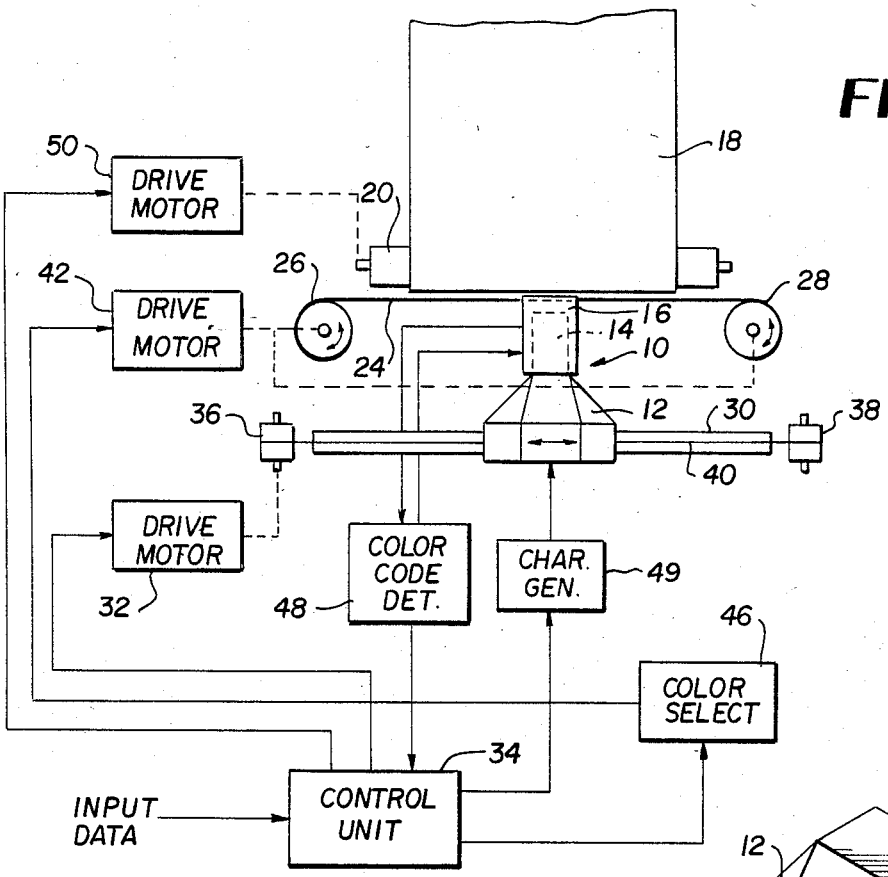
FIG. 1 is a block diagram generally illustrative of an impact dot matrix printer system utilizing the subject invention.

Referring now to the drawings wherein like reference numerals refer to like parts, FIG. 1 discloses in block diagram form a dot matrix type of impact printing system which is comprised of among other things, a print head assembly 10 which includes a conventional impact dot matrix print head 12 having a nose or forward neck portion 14 on which is mounted a photo-optical coding detection subassembly 16. The subassembly 16 comprises the primary component of the subject invention.

The print head 12 comprises a component which is built by various manufacturers such as HiG Magnetics Corporation, Universal Microprinters, Inc. and DH Associates, to name a few, but all of these designs essentially share identical dimensions of the neck 14. Thus the coding detection subassembly 16 can be utilized with print heads provided by several different manufacturers.

Further as shown in FIG. 1, the print head assembly 10 is adapted to be translated back and forth in front of a printing medium 18 consisting of a sheet of paper or other printing material being fed by a platen or drive roller 20. The print head 12, moreover, includes a single or multiple column of print wires 22 (FIGS. 3 and 5) which when activated strike the face of the printing medium 18 through a printing ribbon 24 which is moved bidirectionally between two spools or reels 26 and 28. As will be shown, the ribbon 24 is a multi-colored ink ribbon for selectively printing multi-colored alpha-numeric characters on the printing medium 18 as the print head assembly 10 rides back and forth along a carriage track 30 or some such apparatus. Actuation of the wires is inhibited during ribbon movement to the required printing color.

Travel of the print head assembly 10 across the face of the printing medium 18 is caused by a drive motor 32 which may be, for example, a stepper motor and which operates in response to electrical signals from a control unit 34 for bidirectionally rotating one of a pair of sprockets, toothed gears or pulleys 36 and 38. As shown element 36 is driven. The elements 36 and 38 drive a cable or chain 40 coupled to the print head assembly 12.

In addition to the stepper type drive motor 32, another drive motor 42 is coupled to the reels 26 and 28 of a standard reel to reel or cartridge type inking ribbon system with conventional end of ribbon reversal means for providing rotational drive to the reels 26 and 28 for sequentially positioning in any one direction a required color segment of the multi-colored ink ribbon 24 in front of the print head 12 and the print wires 22 (FIGS. 3 and 5) thereof. The drive motor 42 is driven in accordance with the output of the color select circuit 46 which operates in conjunction with the color coded detector circuit 48 and the control unit 34 as will become evident as the detailed description continues. With the proper color segment in place, a character generator 49 activates a selected number of print wires 22 (FIGS. 3 and 5) in response to a control output from the control unit 34. When desirable, two drive motors could be utilized to provide instantaneous bidirectional movement rather than end of ribbon reversal.

A fourth drive motor 50 receives control signals from the control unit 34 for providing rotation to the drive roller 20 in order to feed the printing medium 18 in a conventional manner as each line or portion thereof is printed.

Figure 4:
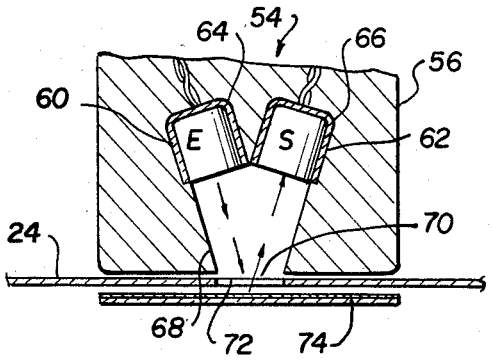
FIG. 4 is a partial sectional view of the embodiment shown in FIG. 3 taken along the lines 4—4 thereof.

Referring now more particularly to the details of the subject invention, reference will now be made to FIGS. 2 through 6. As broadly shown in FIG. 2, the print ribbon 24 passes through ribbon guide structure 52 included on the front portion of a photo-optic color code detector assembly 16. The detector assembly 16 further includes a yoke type housing 54 having a central opening 55 so as to fit over the neck portion 14 of the print head 12 as shown in FIG. 3. The upper and lower body portions 56 and 58 each contain an identical photoemitter and sensor element pair 60 and 62, one of which is shown in FIG. 4 and comprises the upper pair of detector elements located in the upper portion 56 of the housing 54. The emitter 60 may be, for example, a light emitting diode of a known type while the sensor may be comprised of a photo diode or transistor, also of a known type. Further as shown in FIG. 4, the emitter and sensor elements 60 and 62 are located in respective bores 64 and 66 which are mutually angulated and terminate in a common bore.68 which includes an aperture 70. Light emitted from the emitter element 60 is directed toward the print ribbon 24 which if it contains a hole 72, as shown, is reflected from a mirror surface 74 located on the rear of a front plate member 76 back to the sensor element 62. In a like manner, the lower section 58 of the detector housing 54 includes a plate 78 having a reflective surface 80 as shown in FIG. 3 which is adapted to reflect light emitted from the aperture 82.

Figure 2:
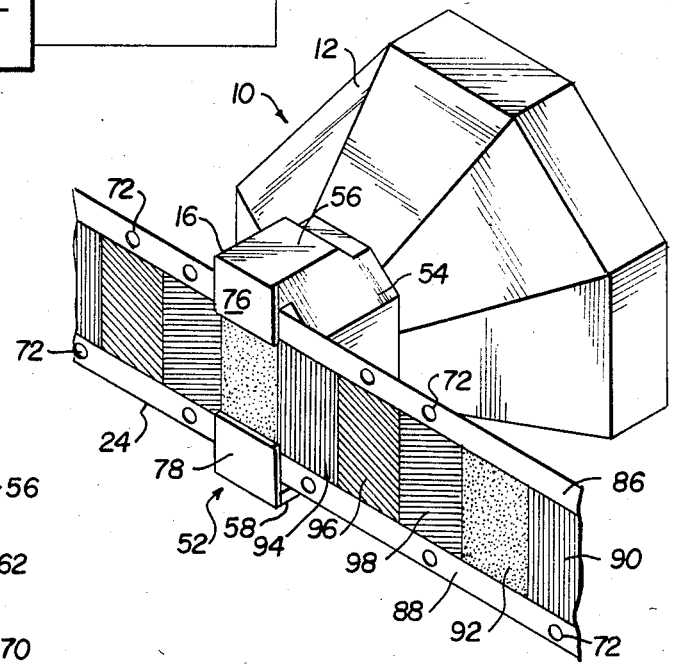
FIG. 2 is a perspective view of the impact dot matrix print head containing the preferred embodiment of the invention.
Figure 3:
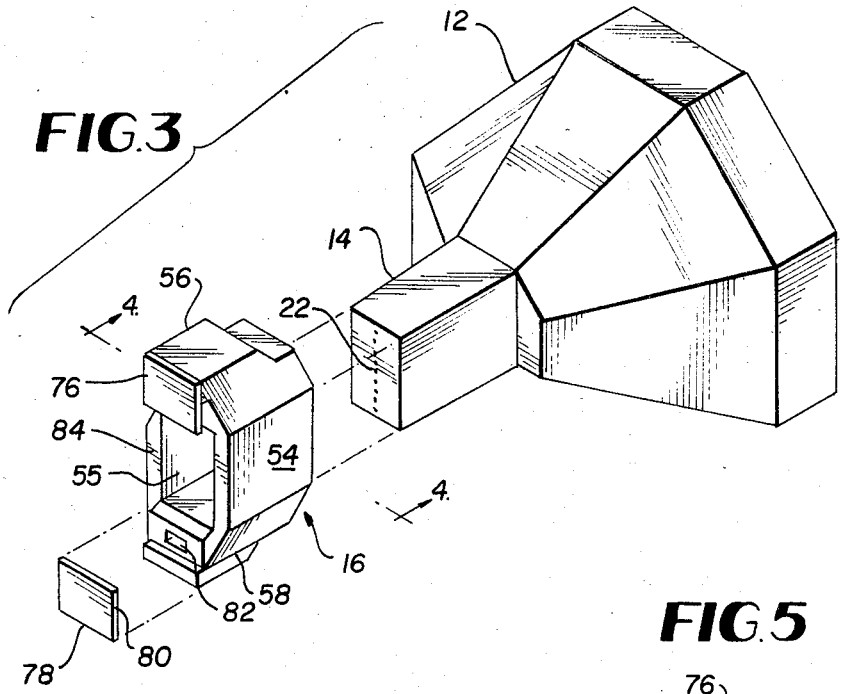
FIG. 3 is an exploded perspective view further illustrative of the embodiment of the invention shown in FIG. 2.
Figure 5:
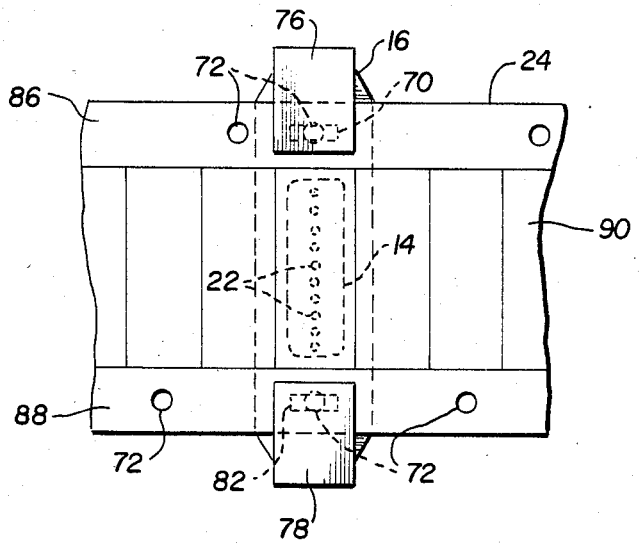
FIG. 5 is a partial front plan view of the embodiment of the invention shown in FIG. 2.
Figure 6:
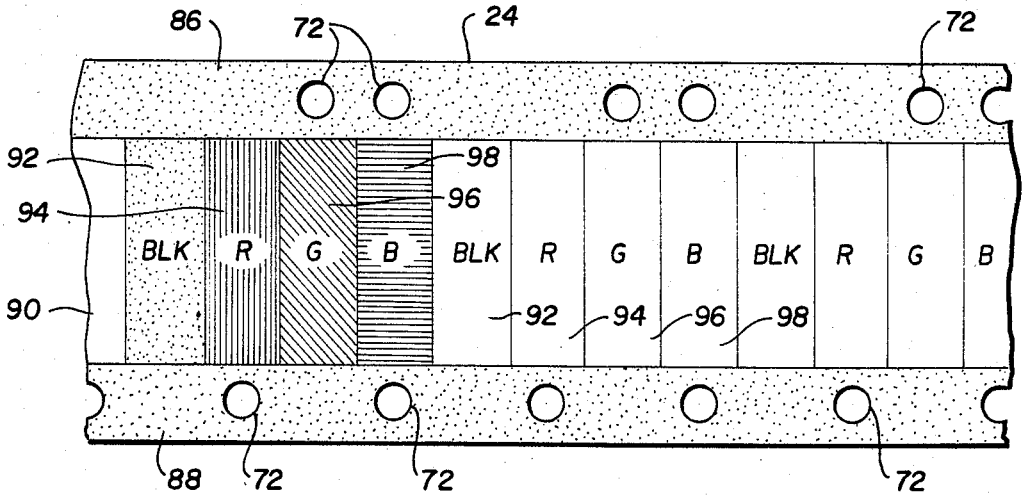
FIG. 6 is a partial front plan view of the multi-color print ribbon in accordance with the subject invention.

It can be seen by referring to FIGS. 2, 3 and 5 that the ink ribbon 24 passes across the face 84 (FIG. 3) of the housing 54 and behind the mirror surfaces 74 (FIG. 4) and 80 of the top and bottom plates 76 and 78 in order to cover top and bottom edge coding regions 86 and 88 adjoining successive mutually different colored ink segments 90 which may be, for example, four generally rectangular vertically oriented segments including the colors black, red, green and blue and being identified by the coded hole pattern 72 is shown in FIG. 6. Referring to FIG. 6, it can be seen that the driven segment 92 which contains black ink, for example, is void of a code hole 72 in either edge region 86 or 88, while the adjoining segment 94 which is colored red, for example, contains a single hole 72 located in the lower edge region in alignment with segment 94. Adjoining the red colored ink segment 94 is a green segment 96 which is coded by way of a single aligned hole 72 located in the upper edge region 86. Finally the fourth color ink segment 98 which is colored blue is coded by two aligned holes 72 that are respectively located in the upper and lower edge regions 86 and 88.

Thus the upper and lower pairs of photo-optical emitter and detector elements sense the presence or lack of a code hole 72 in the upper and lower edge regions 86 and 88 to determine which color is presently in front of the print head 12. This is accomplished by means of the color code detector circuit 48 shown in FIG. 1 which is configured in a simple binary digital logic circuit which implements the truth table as shown in the following Table I.

TABLE I

| Color | Top E/S Binary Output | Bottom E/S Binary Output |
|---|---|---|
| Black | 0 | 0 |
| Red | 0 | 1 |
| Green | 1 | 0 |
| Blue | 1 | 1 |

With the color of the ink segment between the print head and the printing medium 18, the control unit 34 selectively activates drive motor 42 to rotate the ribbon reel 26 until the desired ink color segment appears beneath the print wires 22 (FIGS. 3 and 5).

Thus what has been shown is a simple yet rugged means for feeding a vertically stripped inking ribbon 24 having a repetitive progression of color segments 90 which are coded along the outer edges 86 and 88 of the inking ribbon with the code being photo-optically detected by pairs of emitter/sensor elements located in the upper and lower portions 56 and 58 of a yoke type housing 54 which is mounted over the neck portion 14 of the print head 12. Print color selection can be obtained by either operator input or electronic machine selection in the same manner as the data stream input is coupled to the control unit 34 for controlling the printing of selected alpha-numeric characters across the face of the printing media 18. The color selection code is electronically sensed and compared to a desired color with a match indicating a desired color selection being in front of the print head 12. The print wires 22 are thereafter immediately activated to accomplish a character or symbol print out via the conventional dot matrix printing process.

Where only two colors, for example, are required, only a single emitter/sensor pair would be included in the sensor housing. Also, the width of the vertical color areas may be widened to allow for printing out of a character of more than one printing column, such as five columns wide before going to a different color. Although not shown, a microprocessor could also be incorporated, when desirable, into the printing system as shown in FIG. 1 so that the number of columns needed to print a character could readily be ascertained and could control movement of the inked ribbon accordingly. Additionally, multiple stacked upper and lower emitter/sensor pairs could be added to accommodate as many colors as required. Additional colors may also be obtained by overprint, close proximity printing and dithering techniques. Furthermore, the use of colors such as yellow, cyan and magenta could be employed to blend or mix in order to produce a red, green or blue print. Furthermore, partial mixing of such colors could be utilized to create any number of desirable color shades.

While a hole coded configuration is shown as the preferred embodiment in FIGS. 2 through 7, one may resort to an alternate embodiment wherein the holes are replaced by reflective material or areas of reflective white or silvered ink/paint located on outer edges of the multi-colored ribbon 24. In such an arrangement the mirror surfaces 74 and 80 of the top and bottom plates would be deleted.

Having shown and described what is at present considered to be the preferred embodiment of the present invention, it should be noted that the same has been made by way of illustration and not of limitation. Accordingly, all modifications, alterations and changes coming within the spirit and scope of the invention are herein meant to be included.

I claim:

1. A print head assembly for an impact type printing system including means for optically controlling the position of a colored ink segment of a multi-colored inking ribbon in front of the print head, comprising:

a print head having a forward neck portion;

a color code detector housing in the form of a yoke or collar mounted on said forward neck portion of the print head, said housing including a ribbon guide for translating said inking ribbon past the print head and further including optical code detector means comprising at least one optical source and one optical detector selectively located in the upper or lower portion of said housing;

a translatable inking ribbon, including a plurality of ink segments of mutually different colors located in said ribbon guide in front of said optical code detector means and having optical coding means on at least one outer edge which is in registration with said detector means, said detector means being responsive to said coding means to determine which of said plurality of ink segments is in front of the print head and thereafter if need be, selectively translate said inking ribbon in a direction to position a desired color segment in front of said print head.

2. The print head assembly as defined by claim 1 wherein said optical coding means comprises a coded hole pattern located on said at least one outer edge of said ribbon.

3. The print head assembly as defined by claim 1 wherein said optical coding means comprises photo reflective means located on said at least one outer edge of said ribbon.

4. The print head assembly as defined by claim 1 wherein said detector means comprises two pairs of detector elements each including an optical source and an optical detector, respectively located in said upper and lower portions of said housing, an upper and lower plate forming upper and lower portions of said ribbon guide; and wherein said inking ribbon includes at least three ink segments of mutually different colors and having optical coding means located on both a top and bottom code region adjacent the outer edges of said ribbon, said code regions further being in registration with said pair of detector elements

5. The print head assembly as defined by claim 4 wherein said coding means comprises an aperture pattern.

6. The print head assembly as defined by claim 4 wherein said coding means comprises a pattern of photo reflective elements.

7. A print head assembly for an impact type printing system including means for optically controlling the position of a colored ink segment of a multi-colored inking ribbon in front of the print head, comprising:

a print head having a forward neck portion;

a yoke type of color code detector housing mounted on said forward neck portion of the print head, said housing including a ribbon guide for translating said inking ribbon past the print head and further including at least one optical source and one optical detector selectively located as a pair of detector elements in the upper or lower portion of said housing and a plate forming a part of said ribbon guide having an optical reflecting surface directed toward said pair of detector elements;

a translatable inking ribbon, including at least two ink segments of mutually different colors, located in said ribbon guide intermediate said pair of elements and said optical reflecting surface and having optical coding means on at least one outer edge which is in registration with said pair of detector elements and said reflecting surface, whereby said coding means can be photo-optically read to determine which of said at least two segments is in front of the print head and thereafter if need be, seectively translate said inking ribbon to position a desired color segment in front of said print head.

8. The print head assembly as defined by claim 7 wherein said optical coding means comprises an aperture pattern in said ribbon.

9. The print head assembly as defined by claim 8 wherein said aperture pattern for said at least two ink segments comprises a single aperture adjacent one of said ink segments.

10. The print head assembly as defined by claim 9 wherein said at least two ink segments comprise generally rectangular ink segments arranged side by side with their long dimension being mutually adjacent one another.

11. The print head assembly as defined by claim 10 wherein said print head comprises a dot matrix type of print head having at least one set of linearly arranged print wires and wherein said print wires are in substantial alignment with said rectangular ink segments.

12. The print head assembly as defined by claim 7 wherein said detector housing includes two pairs of detector elements each including an optical source and an optical detector, respectively located in said upper and lower portions of said housing, an upper and lower plate forming upper and lower portions of said ribbon guide with each plate having an optical reflecting surface directed toward a respective pair of detector elements; and wherein said inking ribbon includes at least three ink segments of mutually different colors and having optical coding means located on both a top and bottom code region adjacent the outer edges of said ribbon, said code regions being in registration with said pair of detector elements and said reflecting surfaces of said upper and lower plate.

13. The print head assembly as defined by claim 12 wherein said coding means comprises an aperture pattern.

14. The print head assembly as defined by claim 13 wherein said aperture pattern comprises a single aperture in said top code region adjacent a first segment of said three segments, a single aperture in said lower code region adjacent a second segment of said three segments, and no aperture in either said top and bottom code regions for a third segment of said three segments.

15. The print head assembly as defined by claim 14 and wherein said ribbon includes at least a fourth ink segment of yet another color, and wherein said aperture pattern comprises a single aperture in both said top and bottom code regions adjacent said fourth ink segment.

16. The print head assembly as defined by claim 15 wherein said apertures comprise holes in said ribbon.

17. The print head assembly as defined by claim 15 wherein said ink segments comprise generally rectangular segments arranged side by side with their lengthwise dimension being mutually adjacent one another.

18. The print head assembly as defined by claim 17 wherein said print head comprises a dot matrix type of print head having at least one set of linearly arranged print wires and wherein said print wires are in substantial alignment with said rectangular ink segments.

* * * * *